United States Patent [19]

Kaiser et al.

[11] Patent Number: 4,721,261

[45] Date of Patent: Jan. 26, 1988

[54] WINDING APPLIANCE FOR TOROIDAL CORE COILS

[75] Inventors: Juergen Kaiser, Regensburg; Rudolf Kerler, Pielmuehle, both of Fed. Rep. of Germany

[73] Assignee: Siemens Aktiengesellschaft, Berlin and Munich, Fed. Rep. of Germany

[21] Appl. No.: 863,860

[22] Filed: May 16, 1986

[30] Foreign Application Priority Data

Jun. 7, 1985 [DE] Fed. Rep. of Germany ..... 3520497

[51] Int. Cl.[4] ..... H01F 41/08

[52] U.S. Cl. ..... 242/4 B

[58] Field of Search ..... 242/1.1 E, 4 R, 4 A, 242/4 B, 4 C

[56] References Cited

U.S. PATENT DOCUMENTS

| | | | |
|---|---|---|---|
| 2,168,957 | 1/1937 | Kürsteiner | 242/5 |
| 3,030,038 | 4/1962 | Baker et al. | 242/4 A |
| 3,980,242 | 9/1976 | Schmidt | 242/4 C |
| 3,982,705 | 9/1976 | Peck et al. | 242/4 |
| 4,079,895 | 3/1978 | de Fenffe | 242/4 |

FOREIGN PATENT DOCUMENTS

| | | | |
|---|---|---|---|
| OS2307014 | 8/1973 | Fed. Rep. of Germany . | |
| OS2820674 | 11/1979 | Fed. Rep. of Germany . | |
| 1416648 | 9/1965 | France | 242/4 B |
| 2020624 | 11/1979 | United Kingdom . | |

*Primary Examiner*—Billy S. Taylor

*Attorney, Agent, or Firm*—Hill, Van Santen, Steadman & Simpson

[57] ABSTRACT

An improved toroidal core attaching device for a winding device for toroidal coils including a receptacle sleeve held on a pivotable arm to receive the toroidal core, the core and receptacle being pivotable on the arm into the orbit of an annular wire magazine. The receptacle sleeve is open in a region of its generated surface which is directed to the center of the magazine in the winding position and the receptacle sleeve and toroidal core form a clamp therebetween for an end of the wire. The open region of the receptacle sleeve forms an access opening for the clamping area.

3 Claims, 6 Drawing Figures

FIG 3
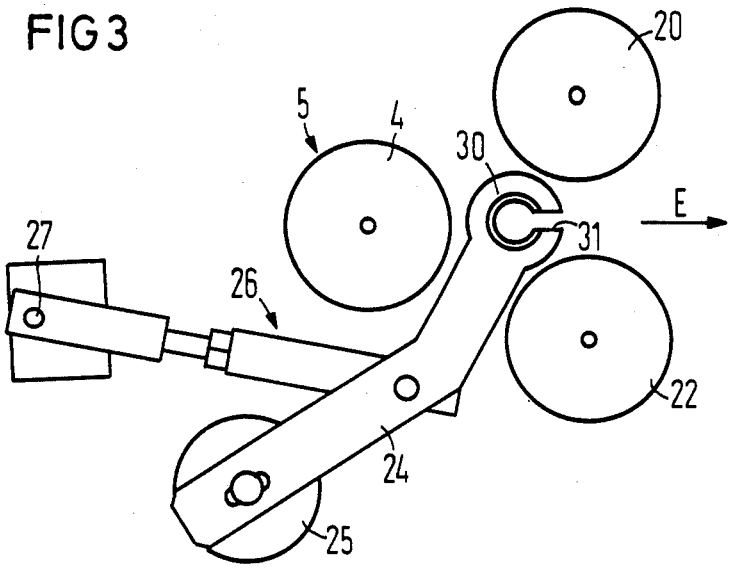
FIG 4
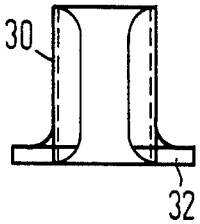
FIG 6
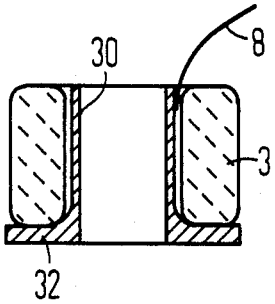
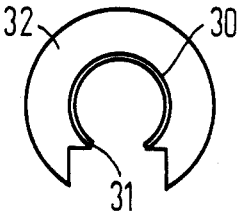
FIG 5

WINDING APPLIANCE FOR TOROIDAL CORE COILS

BACKGROUND OF THE INVENTION

1. Field of the Invention

The present invention relates to a winding appliance for toroidal core coils comprising a toroidal core fixing device, including an annular magazine for wire guidance and magazining which is conducted through the toroidal core opening and may be interrupted in a region of its length, whereby the toroidal core and the magazine are rotatable around their rotationally symmetrical axes, which axes are preferably aligned perpendicular to one another, and comprising a wire feed to the magazine.

2. Description of the Prior Art

Winding appliances for toroidal core coil of this type are known from U.S. Pat. No. 4,079,895. The closed magazine thereof comprises a part closed during winding which can be hinged open for the replacement the toroidal cores. The magazine, moreover, is fashioned such that the magazining of the winding wire is already carried out while the toroidal core is being wound. The beginning of the wire is manually fixed to the toroidal core and is manually guided during the entire winding operation. The threading of the beginning of the wire into the magazine is also managed in a very involved way since the wire must be threaded between brake rollers which effect the required winding tension during winding.

U.S. Pat. No. 3,982,705 discloses a winding appliance for deflector coils comprising a rotatably seated wire supply magazine which is interrupted in a region of its length and comprises a rotating coil winder likewise interrupted in a region of its length to which the wire is supplied from the wire supply magazine. In this winding appliance, too, the beginning of the wire is manually fixed to the wire winder urchin and is manually guided during the winding operation.

German Patent No. 28 20 674 (also Great Britian Patent No. 2020624), finally, discloses a winding appliance for toroidal core coils comprising a toroidal core fixing device, including an annular magazine which is conducted through the toroidal core opening, and is equipped with rotatably seated casters for wire guidance and magazining and is interrupted in a region of its length, whereby the toroidal core and the magazine are rotatable around their rotationally symmetrical axes, which are preferably aligned perpendicular to one another, and comprising a wire feed which is fashioned such that the beginning of the wire is conducted between two casters to a fixing element distinct from the magazine for fixing the beginning of the wire, this fixing element being likewise arranged distinct from the toroidal core and re-releasing the beginning of the wire in the course of winding.

No fixing of the beginning of the wire to the toroidal core ensues given this winding appliance. However, care must be exercised to see that, after release, the beginning of the wire is kept away from the inside hole of the toroidal core by the fixing element; otherwise, the end of the wire hinders the faultless guidance of the winding magazine through the hole of the toroidal core.

SUMMARY OF THE INVENTION

An object of the present invention is to improve a winding appliance for toroidal core coils of the type described above such that, insofar as possible, a manual fixing of the beginning of the wire can be omitted but that at least the manual guidance of the beginning of the winding wire required during the entire winding operation given individual winding appliances can be omitted and the fixing and guidance can largely ensue automatically.

For achieiving this object, the invention provides that the toroidal core fixing device comprises a receptacle sleeve for the toroidal cores which is pivotable into the orbit of the magazine and which is open in that region of its generated surface which is directed to the center of the magazine in winding position.

At the beginning of winding, the toroidal core to be wound is plugged onto this receptacle sleeve, automatically under given conditions, and the receptacle sleeve with the toroidal core is subsequently pivoted into the orbit of the magazine.

Given winding appliances having a wire beginning fixed to the toroidal core, the wire beginning must be manually kept away from the hole of the toroidal core for a brief time until, due to the rotation of the toroidal core during winding, the beginning of the wire is located between the receptacle sleeve and the toroidal core.

Given employment of this toroidal core fixing device in a winding appliance for toroidal core coils known from German Patent No. 28 20 674, this manual securing of the beginning of the wire is also eliminated. Given this preferred winding appliance, it suffices when the fixing element for the beginning of the wire, this fixing element being situated remote from the toroidal core and from the magazine, does not release the beginning of the wire until the wrapped toroidal core is rotated into a position in which the released beginning of the wire is pinched between the receptacle sleeve and the toroidal core.

As viewed in the longitudinal direction of the sleeve, the receptacle sleeved can be divided in two. The inside cross-section of this and of the one-piece receptacle sleeve, of course, is selected larger than the cross-section of the magazine.

The toroidal core fixing device set forth above significantly contributes to the automation of the toroidal core winding operation.

BRIEF DESCRIPTION OF THE DRAWINGS

The invention shall be set forth in greater detail below with reference to an exemplary embodiment. Shown are:

FIG. 3 is an exemplary embodiment of a toroidal core fixing device of the invention which is suitable for a winding appliance of FIGS. 1, 2, shown in plan view.

FIG. 4 is a side elevational view of a receptacle sleeve embodying the principals of the present invention.

FIG. 5 is a plan view of the receptacle sleeve of the invention of FIG. 4.

FIG. 6 is the receptacle sleeve of FIGS. 4 and 5 with toroidal core plugged on and wrapped, shown in a sectional side view.

DESCRIPTION OF THE PREFERRED EMBODIMENTS

Figure 1:
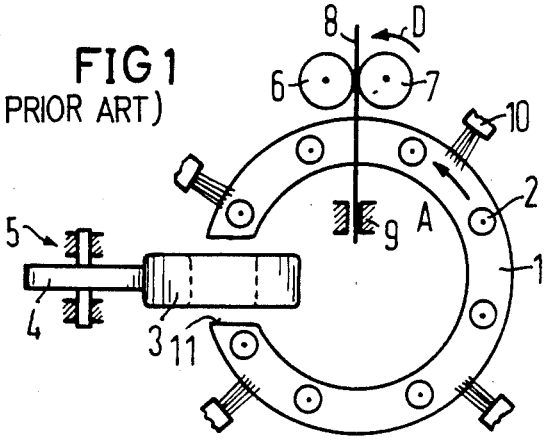
FIG 1 (PRIOR ART)
FIG. 1 is a schematic illustration and side view of a winding appliance for toroidal core coils known per se from German Patent No. 28 20 674, being shown in a first work position.
Figure 2:
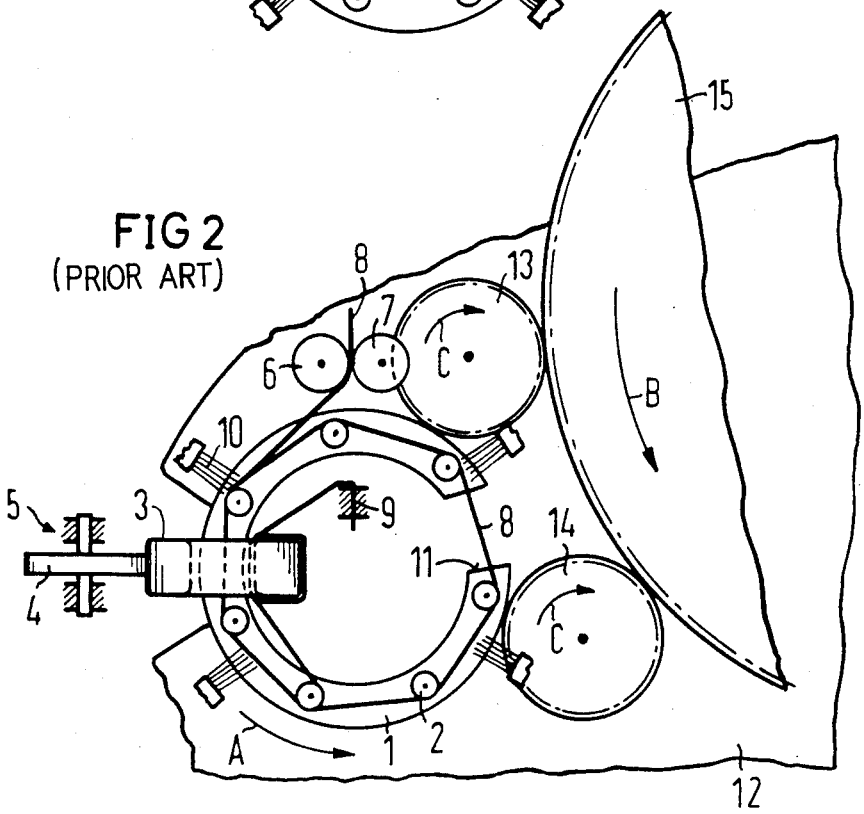
FIG 2 (PRIOR ART)
FIG. 2 is the winding appliance of FIG. 1 in a second work position, shown in the same manner of presentation.

The winding appliance of FIGS. 1 and 2 comprises an annular magazine 1 which is interrupted by a gap at 11 and which carries casters or bearing rollers 2 at its one end face, these casters 2 being spaced from one another. A drive means 5 includes a drive wheel 4 rotatably seated on a shaft, this drive wheel 4, together with further wheels 20, 22 (see FIG. 3) likewise rotatably seated on shafts, pressing against the outside generated surface of a toroidal core 3 held in a toroidal core fixing device of FIGS. 3 through 6. In the illustration of FIG. 2, the magazine 1, which is fashioned as a ring, particularly as a gear rim, is rotated in the direction of arrow A. The transport is thereby composed of a conveying wheel 15 which, upon rotation in the direction of arrow B, meshes with the gear rim of the magazine via intervening conveying wheels 13, 14 which rotate in the direction of arrow C. The toroidal core 3 and the magazine 1 are thereby rotatable around their rotationally symmetrical axes which are aligned perpendicular to one another. The elements of the winding appliance are thereby arranged on a mounting plate 12, some being rigidly arranged and some being rotatably arranged.

A winding wire 8 is drawn off from a supply reel (not shown in the drawing) and is conveyed in magazine direction by means of conveying rollers 6, 7 which accordingly rotate in the direction of arrow D. A non-rotatable clamp element 9 serves the purpose of fixing the beginning of the wire, this clamp element 9 being located at a distance from the magazine and from the toroidal core 3.

The magazine 1, which comprises, for example, a gear rim, and the casters 2 are integrated in a tubularly shaped cladding (not shown in the drawing) which is continuously open toward the center of the gear rim, is arranged in non-turning fashion and interrupted in a region of its length, this cladding comprising a wire passage in the region of the wire feed.

Adjustable brushes 10 which press against the magazined wire with higher or lower pressure depending on the desired winding tension are situated in the inside of the cladding (not shown). It is thereby possible to appropriately control to winding tension, this being additionally elevated at the beginning of winding by the winding-off tension and noticeably decreasing when the magazine becomes empty.

The toroidal core fixing device comprises a receptacle sleeve 30 (see FIG. 4) arranged on a swivel arm 24, this receptacle sleeve 30 having an annular flange 32 for the seating of the toroidal core 3 and having a region 31 of its generated surface which is open toward the center of the magazine in winding position.

In the illustration of FIG. 3, the swivel arm 24, which is pivotably seated and has it swivel motion damped by a damping means 26, 27 is swivelled into the winding position which is directed toward the center of the magazine, see arrow direction E. The drive wheel 4 and the further wheels 20, 22 thereby press against the outside generated surface of the toroidal core 3 shown in FIG. 6 which is slipped onto the receptacle sleeve 30.

FIG. 6 shows the winding position of the toroidal core 3 in which the toroidal core 3 has the beginning of its winding wire 8 turned out of the open region 31 of the generated surface of the receptacle sleeve 30 and, consequently, clamped between the receptacle sleeve and the toroidal core and, thus, being secured. The core 3 is rotated relative to the receptacle sleeve 30 after an initial convolution of wire is placed on the core to thereby carry the initial convolution into damping engagement with the sleeve.

The manner of functioning of this winding appliance and the advantages attainable by means of this appliance, especially the advantages with respect to automation and outlay reduction, can be illustrated by the following example which describes the manufacture of a current compensated, double choke.

(a) The receptacle sleeve 30 with plugged-on toroidal core 3 is swivelled into the orbit of the magazine given an appropriate position of the magazine 1.

(b) The wire 8 is inserted between the casters 2.

(c) The beginning of the wire is fixed in the clamp element 9.

(d) The magazine is first moved slowly in the direction of arrow A and, upon rotation of the toroidal core 3, the wire fitted to the toroidal core is clamped between the receptacle sleeve and the toroidal core.

(e) The beginning of the wire is released and the rotational speed of the magazine is controlled.

(f) The wire is severed from the supply reel.

(g) The position of the brushes is adapted to the desired winding tension and the winding speed is boosted to its maximum speed.

(h) The rotational motion of the magazine is retarded and the magazine is slowly brought into the initial position.

(i) The magazine is stopped.

(j) The tail of the wire is removed and the core is subsequently rotated further.

(k) Steps a) through h) are repeated, the winding direction being reversed if desired.

In the work sequence set forth above, each winding for the double choke type is separately magazined. Programming can thereby be freely carried out, namely dependent upon whether windings in the same direction or in opposite directions are desired; furter, the magazine now need only accept half as much wire and, thus, can be further miniaturized.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A winding appliance for toroidal core coils comprising a toroidal core attaching device, including an annular magazine for magazining wire to be wound on said toroidal core, wherein said magazine is conducted through the toroidal core opening, is equipped with rotatably seated casters for wire guidance, and is interrupted in a region of its length, and wherein the toroidal core and the magazine are rotatable around their rotationally symmetrical axes which are preferably aligned perpendicular to one another, including a wire feed which is fashioned such that the beginning of the wire is guided between two casters to an element for attaching the beginning of the wire which is distinct from the magazine and which is also arranged distinct from the toroidal core and which re-releases the beginning of the wire in the course of the winding operation, and including adjustaable brushes which press against the magazined wire with a pressure corresponding to the desired winding tension, having the improvement that said toroidal core attaching device comprises a receptacle sleeve for said toroidal cores, said receptacle sleeve being held on a pivotable arm by means of which said receptacle sleeve is pivotable into the orbit of said magazine and wherein said sleeve is open in a region of its generated surface which is directed to the center of said magazine in a winding position and said receptacle sleeve and said toroidal core forming a clamp therebetween for said wire which is accessible at said open region of said receptacle.

2. A winding appliance for toroidal core coils according to claim 1, wherein said receptacle sleeve is divided into in longitudinal direction of said sleeve.

3. A winding appliance for toroidal core coils according to claim 1, wherein the inside cross-section of said receptacle sleeve is greater than the cross-section of said magazine.

* * * * *